United States Patent [19]

Nagao

[11] Patent Number: 4,635,428

[45] Date of Patent: Jan. 13, 1987

[54] FLATTENED CARDBOARD BOX SUPPLYING APPARATUS

[75] Inventor: Eijiro Nagao, Kanagawa, Japan

[73] Assignee: Fuji Photo Film Co., Ltd., Kanagawa, Japan

[21] Appl. No.: 785,566

[22] Filed: Oct. 8, 1985

[30] Foreign Application Priority Data

Oct. 12, 1984 [JP] Japan ..... 59-212448

[51] Int. Cl.[4] ..... B65B 35/40

[52] U.S. Cl. ..... 53/542; 198/748; 271/3.1; 271/150; 53/564

[58] Field of Search ..... 53/542, 564; 271/3.1, 271/149, 150; 414/37, 109; 198/748

[56] References Cited

U.S. PATENT DOCUMENTS

| | | | |
|---|---|---|---|
| 2,252,469 | 8/1941 | Nyberg | 271/149 |
| 2,318,208 | 5/1943 | First | 53/564 X |
| 2,757,502 | 8/1956 | Dasch | 53/564 |
| 2,853,296 | 9/1958 | Skow | 271/3.1 |
| 3,655,072 | 4/1972 | Bateman | 414/37 |
| 4,531,343 | 7/1985 | Wood | 53/542 |

FOREIGN PATENT DOCUMENTS

| | | | |
|---|---|---|---|
| 2749424 | 1/1979 | Fed. Rep. of Germany | 53/542 |

*Primary Examiner*—John Sipos

*Attorney, Agent, or Firm*—Young & Thompson

[57] ABSTRACT

An automatic apparatus for supplying flattened cardboard boxes or work units to an automatic packing machine. The apparatus comprises a first belt conveyor on which the work units are placed groupwise in a standing posture closely in contact with each other, a second belt conveyor onto which the work units on the first are transferred while maintaining them upright, a holding bracket slippingly disposed on the first belt conveyor, and retaining means provided at the juncture of the first and second belt conveyors. The holding bracket is adapted to be borne by friction so as to hold and push the work units upright in close contact and to slip on the first conveyor belt owing to the reaction from the work. The retaining means comprises two holding pins which are kept retracted under the belts until the work has been completely transferred onto the second belt conveyor and then project above the belt conveyor so as to hold the work units from the rear to prevent them from falling backward.

10 Claims, 5 Drawing Figures

FLATTENED CARDBOARD BOX SUPPLYING APPARATUS

BACKGROUND OF THE INVENTION

1. Field of the Invention

The present invention relates generally to a flattened carboard box supplying apparatus, and more particularly to such apparatus which is used to automatically supply flattened cardboard boxes to an automatic film-packing machine or the like.

2. Description of the Prior Art

In film-packing operations, flattened cardboard boxes (which are hereinafter referred to as work units) are supplied to the automatic film-packing machine in which each work unit is expanded for receiving a plastic case containing a cartridge including a roll of film therein. Specifically, the work unit supplied to the automatic film-packing machine is at first expanded to be in the form of a square tube and then the flaps of the work unit at the bottom side are fastened to each other with paste so as to form an open-topped square box into which the plastic case generally having a cylindrical configuration is inserted. After the insertion of the plastic case thereinto, the flaps of the box at the top side are also fastened to each other with paste for completely packing the plastic case.

For supplying the work units to the automatic film-packing machine, it is usual to use belt conveyors on which the work units are placed upright and closely in contact. Heretofore, operators have handled manually a number of work units at a time for placing the work units on the belt conveyor. Because of the handling capacity of the automatic film-packing machine, which is generally 500 to 1,000 pieces per minute, for example, frequent work supplying operations have been required.

For solving this problem, there has been proposed a conveyor apparatus of the type having inclined, curved conveyor belts, as disclosed in Japanese Utility Model Appln. No. 58-29364. That apparatus, which is adapted to provide a long interval of time for supplying the work, has however left a serious problem unsolved. The problems, which is in the automatic work supply, seems to be solvable by using a robot hand well known per se. However, when using a robot hand, there arises the problem that the work units often fall like dominoes after being placed on the conveyor belt by the robot hand. This makes it impossible to continuously supply the work units to the automatic film-packing machine.

OBJECTS OF THE INVENTION

Therefore, it is a primary object of this invention to provide an apparatus for automatically supplying flattened cardboard boxes to a film-packing machine which executes automatically film-packing operations.

It is another object of the present invention to provide a flattened cardboard box supplying apparatus in which a number of flattened cardboard boxes are placed group by group in a standing posture in a row on and conveyed by conveyor belts without falling down.

It is a further object of the present invention to provide a flattened cardboard box supplying apparatus which can be operated efficiently.

Other objects of the invention will be in part obvious and will in part appear hereinafter.

SUMMARY OF THE INVENTION

For accomplishing the above-mentioned objects, there is provided an automatic apparatus for supplying flattened cardboard boxes (which are hereinafter referred to as work units) to an automatic film-packing machine, which apparatus comprises a first belt conveyor on which a number of work units are placed groupwise in a standing posture closely in contact with each other, and a second belt conveyor onto which the work previously placed on the first belt conveyor is transferred and which conveys the work toward the automatic film-packing machine. As means for placing the work on the first belt conveyor, a robot hand, which is well known per se, is used for handling the work so as to place the work units in a standing posture in a row on the first belt conveyor. As means for transferring the work units onto the second belt conveyor whilst maintaining them upright, there is provided a holding bracket slippingly disposed on the first belt conveyor, said holding bracket being adapted to be borne by friction so as to hold and push the work units upright in close contact and to slip on the first conveyor belt owing to the reaction from the work. At the juncture of the first and second belt conveyors, there is provided retaining means for preventing the work units transferred onto the second belt conveyor from falling backward. The retaining means comprises two holding pins which are kept retracted under the belts until the work has been completely transferred onto the second belt conveyor and then project above the belt conveyor so as to hold the work units from the rear to prevent them from falling backward.

At this time, according to the present invention, the first belt conveyor is forced to move in a reversed direction in order to move the holding bracket to its rearward limit position, permitting placing work units of the following group on the first belt conveyor between the holding bracket and the holding pins. After the work units of another group have been placed on the first belt conveyor with the robot hand, the holding bracket is again borne forwardly, while the holding pins are retracted, so that the work units having been placed on the first and second belt conveyors can be assembled in a standing posture.

BRIEF DESCRIPTION OF THE DRAWINGS

The invention, and its objects and advantages, will become more apparent in the detailed description of the preferred embodiment presented below, reference being made to the accompanying drawings, in which.

DETAILED DESCRIPTION OF THE PREFERRED EMBODIMENT

Figure 1:
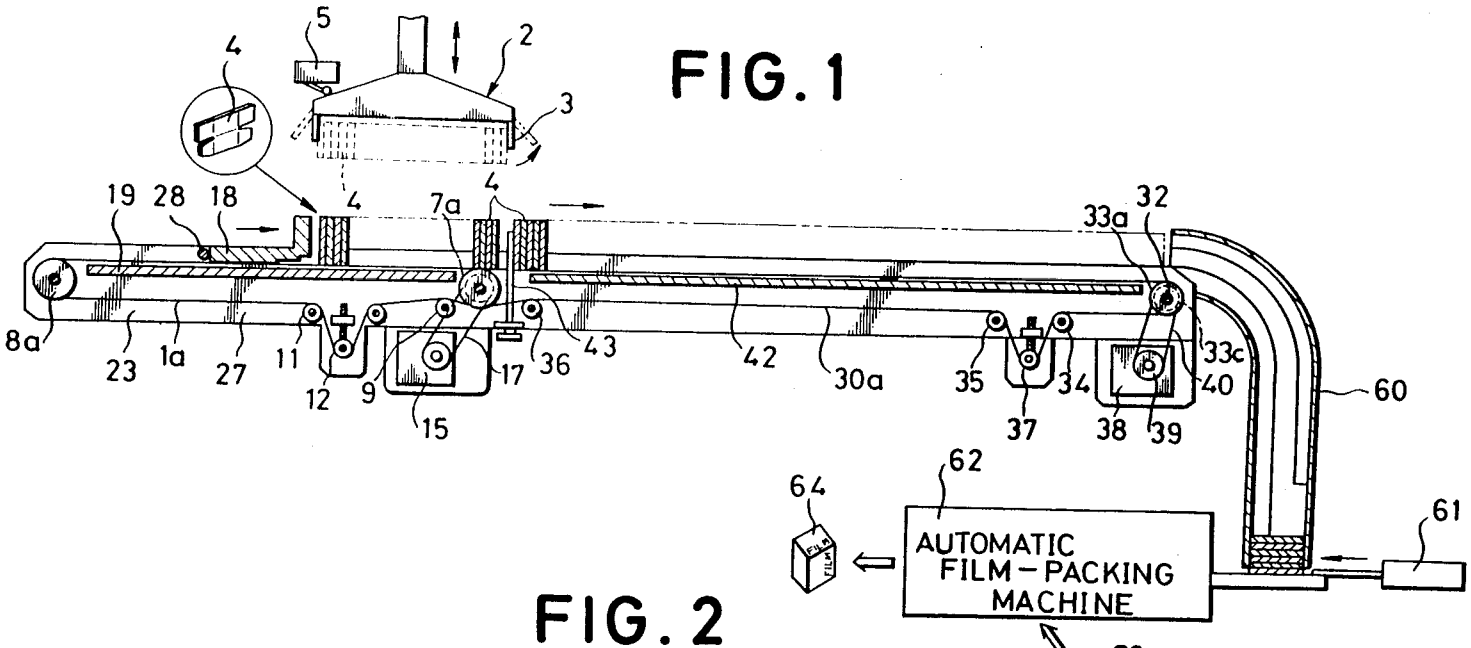
FIG. 1 is a schematic cross sectional view of the flattened cardboard box supplying apparatus according to an embodiment of the present invention.

First of all, the operation of a robot hand 2 which is preferably used in cooperation with the flattened cardboard box supplying apparatus in accordance with the present invention, but which does not constitute any part of the present invention, will be described. As shown in FIG. 1, the robot hand 2 which is used for placing a plurality of flattened cardboard boxes 4 (which are hereinafter referred to as work units) groupwise on conveyor belts is disposed above the belts for vertical and rotatable movement. The robot hand 2 has a pair of arms 3 supported thereon for opening and closing pivotal movement in order to hold therebetween the work units disposed in close circuit in a container (not shown) and then to remove them from the container for placing them on the conveyor belts. After this placement, the robot hand 2 moves upwardly to actuate a detecting switch 5 to turn ON, thereby to detect the return of the robot hand 2 to its initial position.

Figure 2:
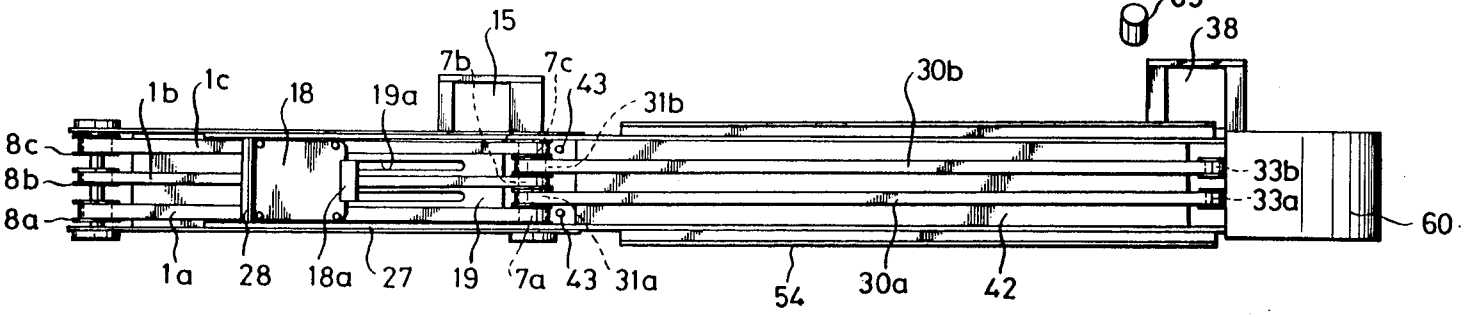
FIG. 2 is a plan view of the apparatus shown in FIG. 1.

Referring to FIGS. 1 and 2, shown therein is the flattened cardboard box supplying apparatus according to the present invention, which includes first and second conveyor belt assemblies, the first comprising three endless belts 1*a*–1*c* extending between three pairs of driving pulleys 7*a*–7*c* secured on a shaft 14 and driven pulleys 8*a*–8*c* rotatably mounted on a shaft, the other comprising two endless belts 30*a*, 30*b* extending between two pairs of driven pulleys 31*a*, 31*b* rotatably mounted on the shaft 14 and driving pulleys 33*a*, 33*b* secured on a shaft 32. Secured on the shaft 14 is a pulley 7*d* which is connected to a pulley 16 secured on the shaft of a motor 15 through a belt 17, thus the revolution of the motor 15 is transmitted to the driving pulleys 7*a*–7*c* to advance the belts 1*a*–1*c* forwardly, in order to move work (flattened cardboard boxes) placed thereon.

The motor 15 is controlled to rotate pulley 16 counterclockwise (as viewed in FIG. 3) prior to the supply of work units 4 for another group, and then, at the completion of the supply, to rotate pulley 16 in a clockwise direction so as to advance the belts 1*a*–1*c* for the forward movement of the work units 4 placed therein. For giving the proper tension to each first belt there are provided guide rollers 9–11 and a tensioning roller 12; the latter is adjustable vertically in order to set the tension in the belt to a desirable value.

On the first belts 1*a*–1*c* there is placed a retaining bracket 18 having an upstanding plate 18*a* which has a generally L-shaped configuration and is made of low frictional resistance material such as Teflon for easy slipping on the first belts. For the purpose of the prevention of flexure of the first belts 1*a*–1*c* due to the weight of the retaining bracket 18, work units 4 and the belts themselves, there is provided below and close to the belts 1*a*–1*c* a back-up plate 19 which has guide slots 19*a* that receive pins 18*b* on the holding bracket 18.

For detecting the position of the retaining bracket 18 there are provided sensing switches 20, 21 such as reflection type photosensors which are adapted to detect the pin 18*b* when the retaining bracket 18 is moved to its forward and rearward limit positions.

Figure 4:
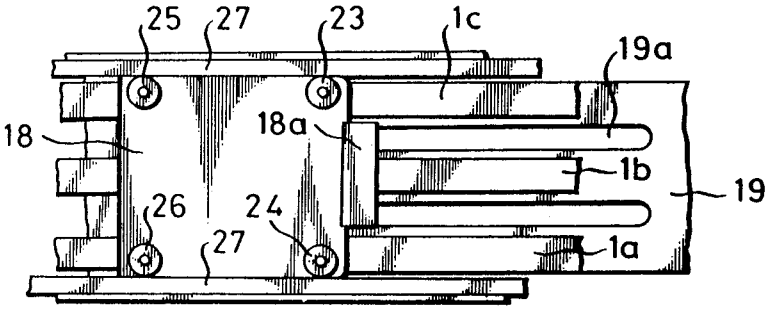
FIG. 4 is a plan view showing a holding bracket.

As shown in detail in FIG. 4, the retaining bracket 18 is provided with four guide rollers 23–26 which are rotatably mounted thereon and in contact with the inner surfaces of frame bars 27 disposed parallel to each other. Designated by the numeral 28 is a transverse bar provided between the frame bars 27 which serves as a stop for rearwardly limiting the movement of the retaining bracket 18 as well as preventing excessive movement of the retaining bracket 18 that might result from the slippage occurring between the holding bracket 18 and the first belts 1*a*–1*c*.

In the same way as described for the first belts 1*a*–1*c*, fixedly secured on the shaft 32 is a pulley 33*c* which is connected to a pulley 39 secured on the shaft of a motor 38, through a belt 40. Thus the rotation of the shaft of the motor 38 is transmitted to the driving pulleys 33*a*, 33*b* to advance the second belts 30*a*, 30*b* in order to move the work units 4 having been transferred thereonto from the first belts 1*a*–1*c*. For properly tensioning each second belt there are provided guide rollers 34, 35 and a tensioning roller 37 which is vertically adjustable in order to set the tension to be exerted on the belt to a desirable value. There is also provided below and close to the second belts 30*a*, 30*b* a back-up plate 42 for the purpose of preventing the flexure of the belts 30*a*, 30*b* due to the weight of the work units thereon and the belts themselves.

Figure 3:
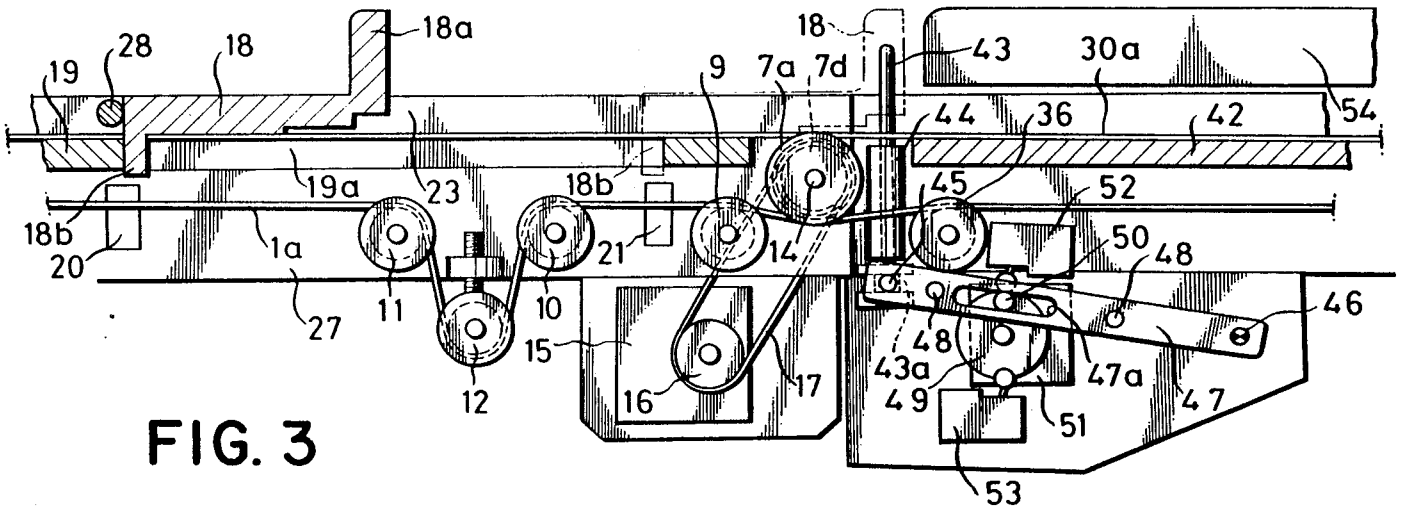
FIG. 3 is a schematic cross sectional view of the essential part of the apparatus shown in FIG. 1.

In order to prevent the work units 4 on the second belts 30*a*, 30*b* from falling down backwardly when the holding bracket 18 is moved rearward for permitting work from the following group to be placed on the first belts 1*a*–1*c*, there is provided a pair of retaining pins 43, each of which, as is shown in detail in FIG. 3, is supported in a sleeve 44 for vertical movement between an extended and a retracted position, which movement results from the engagement between an annular groove 43*a* formed at the lower portion of the retaining pin 43 and a pin 45, the latter being provided at the end of an arm 47 supported on a shaft 46 for pivotal movement. A pair of the arms 47, one for each retaining pin 43, are integrated with each other by means of connecting rods 48. Either one of the arms 47 is provided with an elongated slot 47*a* slidably engaged by a pin 50 which is mounted on a disc 49 to be rotated by a motor 51 for producing vertical swinging movement of the arms 47. On the circular path of the pin 50, there are provided means for sensing positions of the retaining pin 43, i.e., a switch 52 for the upper position and a switch 53 for the lower position. Each of the switches 52, 53 can be caused to turn ON by the pin 50 at its uppermost and lowermost positions.

In FIG. 3, designated by the numerals 54 are guide plates disposed on both sides of the second belts 30*a*, 30*b* for guiding both sides of the work units 4.

As shown in FIG. 1, adjacent to the second conveyor belt assembly, there is installed a gradually curved chute 60 for introducing the work 4 to the feeding stage and piling it up in the chute 60. At the exit end of the chute 60 is means 61 for pushing the work units 4 out one by one so as to feed them into a cooperatively installed automatic film-packing machine 62, which does not comprise any part of the invention, and in which the work 4 is expanded as previously mentioned in order to receive therein a plastic case 63 including a film cartridge. A film package 64 from the automatic film-packing machine 62 may be then further handled, for example, by packing in a carton.

Figure 5:
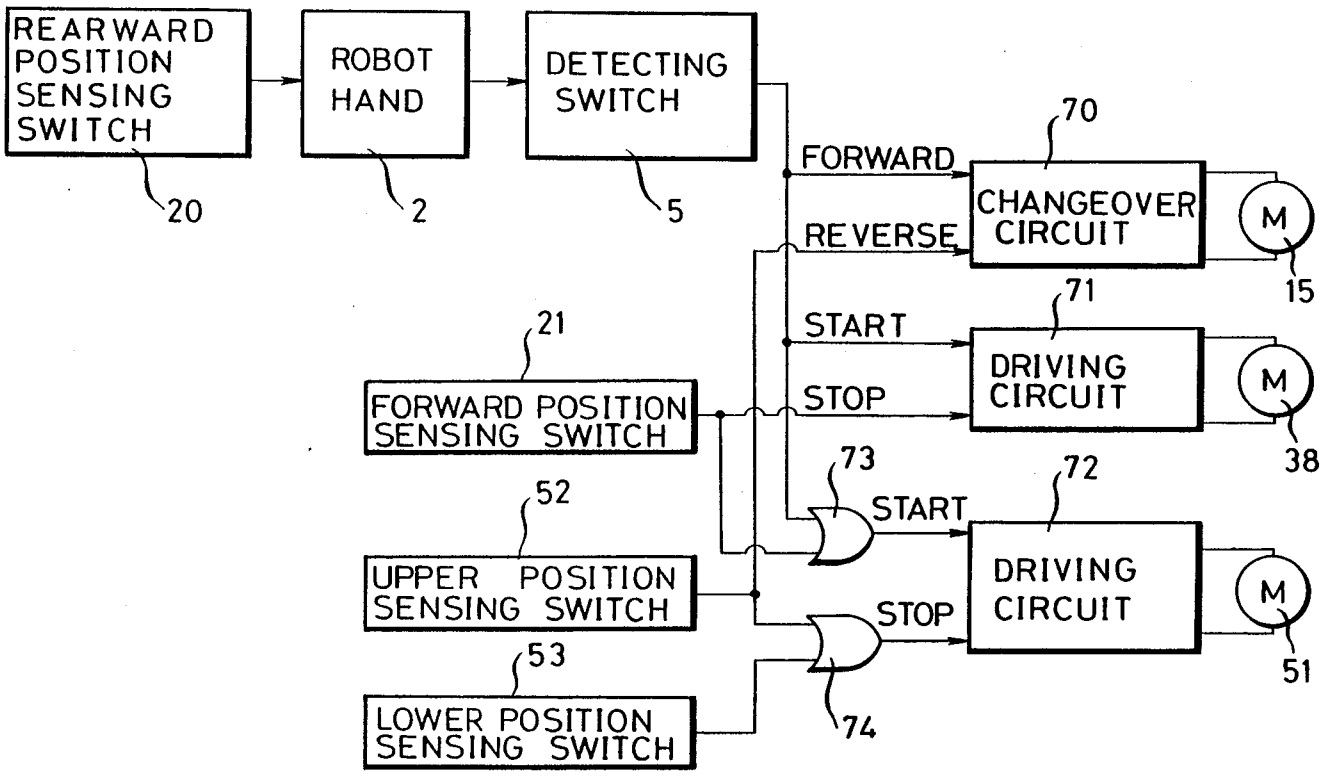
FIG. 5 is a block diagram of a control circuit for motors used in the apparatus.

Reference is now had to FIG. 5, in block diagram form, showing motor control means including a changeover circuit 70 for the motor 15 and drive control circuits 71, 72 for the respective motors 38, 51. The changeover circuit 70 which is the means for reversing the running direction of the motor 15 can cause the motor 15 to run in the normal or clockwise direction after having received a signal from the detecting switch 5 actuated by the robot hand 2, and can cause the motor 15 to be reversed so as to run in the reverse or counterclockwise direction upon receiving a signal emitted by the upper position sensing switch 52.

The drive control circuit 71 which maintains the motor 38 running after having received the same signal from the detecting switch 5 prevents the motor 38 from running when receiving a signal emitted by the position sensing switch 21. The other drive control circuit 72 causes the motor 51 to start to rotate in the presence of a signal at the output of OR circuit 73 which is actuated by a signal from either the detecting switch 5 or the position sensing switch 21. On the other hand, another OR circuit 74 is provided which outputs a signal responsive to either one of the signals from the uppermost and lowermost position detecting switches 52, 53 in order to stop the rotation of the motor 51.

According to the operation of the flattened cardboard box supplying apparatus of the present invention, just before supplying work units of the following group, the work units 4 of the previous group are placed on the second belts 30*a*, 30*b* while being prevented from falling down backwardly by the retaining pins 43 which have extended, while the holding bracket 18 has retracted to the stop bar 28 and remains there. When the condition of the apparatus is thus, the position sensing switch 20 is actuated to turn ON so as to provide a signal which serves to actuate the robot hand 2. Therefore, in the presence of the signal, the robot hand 2 at first holds work units 4 of the following group (the number of which is about 200 pieces in this embodiment) standing closely in contact in a container, with arms 3 and then removes them from the container. Continuously, the robot hand 2 rises and turns to change direction so as to position the arm 3 above the first belts 1*a*–1*c*, and then the robot hand 2 comes down close to the first belts 1*a*–1*c* in order to release the work units 4 by opening the arms 3 to place them on the belts 1*a*–1*c* while keeping them closely in contact. For permitting the arms 3 to be opened without any interference, there are provided between not only the holding bracket 18 and the rearmost work unit but also the retaining pin 43 and the foremost work unit spaces owing to which, after the robot hand 2 has risen, the work units 4 will be liable to fall down forwardly and rearwardly. However, since each space is narrow in comparison with the height of the work, the work units 4 lean on the holding bracket 18 and the retaining pin 43.

The robot hand 2, when rising away from the first belts 1*a*–1*c*, actuates the detecting switch 5 to turn ON, causing the motors 15, 38, 51 simultaneously to rotate. As a result, as mentioned hereinbefore, the first and second belts are forwardly advanced, so as to move the holding bracket 18 and the work 4 thereon forward. At this time, as a result of rotation of the motor 51, not only is the retaining pin 43 caused to retract below the second belts 30*a*, 30*b*, but also the disc 49 is rotated so as to cause the lower position sensing switch 53 ON by means of the pin 50 eccentrically mounted on the disc 49 for stopping the rotation of the motor 51.

On the one hand, the motor 38 is adapted to advance the second belts 30*a*, 30*b* so as to move the work at a speed corresponding to the handling capacity of the automatic film-packing machine 62; and on the other hand, the motor 15 is adapted to advance the first belts 1*a*–1*c* at a speed higher than that of the second belts in order to eliminate the spaces between the holding bracket 18 and the work and the retaining pin 43 and the work. This is the reason why the work 4 on the first belts 1*a*–1*c* is abutted with the work on the second belts 30*a*, 30*b*. After the work groups are pressed together, the holding bracket 18 is subjected to the reaction force from the work 4 so that slippage occurs between the holding bracket and the first belts 1*a*–1*c*, resulting in the compensation of the difference in speed between the first and second belts. Consequently, the holding bracket 18 does not exert any excessive force on the work 4.

Between the holding bracket 18 and the outlet of the chute 60 there is an angle supply of work units 4 in a series and the work units 4 are kept standing and are gradually forwarded by the holding bracket 18. Once the work units 4 enter into the chute 60, the work units 4 are turned in their direction of movement through an angle of about 90°, being piled up in the chute 60. Thereafter, each work unit 4 at the exit of the chute 60 is pushed out by means of the pushing means 61 so as to be fed into the automatic film-packing machine 62 in which the work unit is expanded and a plastic cartridge 63 is accommodated therein for providing a film package as a completed product 64.

When the holding bracket 18 is moved forward to the position where the upstanding plate 18*a* reaches the second belts 30*a*, 30*b*, the work units 4 of a group are fully transferred onto the second belts 30*a*, 30*b* from the fist belts 1*a*–1*c*. The full transfer of the work units 4 can be achieved by detecting the pin 18*b* on the holding bracket 18 by the position sensing switch 21. Upon the detection of the pin 18*b*, the position sensing switch 21 produces a signal which in turn serves to stop the rotation of the motor 30, so as to suspend circulation of the second belts 30*a*, 30*b*. Simultaneously, the motor 51 is actuated for rotation so as to move the retaining pins 43 up beyond the second belts 30*a*, 30*c* on both sides of the upstanding plate 18*a* of the holding bracket 18. In the uppermost position of the retaining pins 43 the pin 50 eccentrically mounted on the disc 49 actuates the upper position sensing switch 52 to turn ON so as to produce a signal which serves not only to stop the rotation of the motor 51 but also to reverse the rotation of the motor 15.

As a result of the reversed rotation of the motor 15, the first belts 1*a*–1*c* are caused to move rearwardly so as to remove the holding bracket 18 from the work 4 transferred onto the second belts 30*a*, 30*b*. At this time, due to the removal of the holding bracket 18, the work units 4 lean against the retaining pins 43 and thereby are prevented from falling backward. The holding bracket 18 is further moved to and then restrained by the stop bar 28, so that the holding bracket 18 is left in the restrained or rearward position with slipping. At this time, the rearward position sensing switch 20 detects the pin 18*b* of the holding bracket 18 to produce a signal which in turn causes the operation of the robot hand 2 for supplying work units for the next group following the same operation as described above.

What is claimed is:

1. An apparatus for supplying flattened cardboard boxes, comprising:

first conveyor means comprising drive means for selectively moving said conveyor means forwardly and rearwardly, on which said first conveyor a plurality of flattened cardboard boxes is placed in a standing posture in a row, and first retaining means carried by said first conveyor means for retaining said row of flattened cardboard boxes in a standing posture from the rear during forward movement of said first conveyor means, said first retaining means being moved by said first conveyor means between a forward and rearward position and slidable relative to said first conveyor means;

second conveyor means disposed aligned with and adjacent said first conveyor means so as to form with said first conveyor means a continuous path for the said flattened cardboard boxes, said second conveyor means comprising drive means for selectively driving said second conveyor means forwardly, and second retaining means rigidly secured in the path of said second conveyor means, said second retaining means being designed to move between: (1) an extended position in which said second retaining means cooperates with said first retaining means in its forward position to retain said row of flattened cardboard boxes in a standing posture from the rear; and (2) a retracted position, and means for driving said second retaining means between said extended and retracted positions;

first detecting means for detecting said forward position of said first retaining means, said drive means for said second retaining means operating to extend said second retaining means responsive to the detection of first retaining means at its forward position by said first detecting means; and second detecting means for detecting the extended position of said second retaining means, said drive means for said first conveyor means operating to drive said first conveyor means rearwardly responsive to said second detecting means.

2. An apparatus according to claim 1, wherein said rearward position of said first retaining means comprises an abutment against which said first retaining means abuts at its rearward position when driven rearwardly by said first conveyor means, whereby said first retaining means will slip relative to said first conveyor means so as to retain said first retaining means at its rearward position while another row of flattened cardboard boxes is loaded on said first conveyor means.

3. An apparatus according to claim 2, wherein said first retaining means is formed from a material with a low frictional resistance relative to said first conveyor means.

4. An apparatus according to claim 3, wherein said material is Teflon.

5. An apparatus according to claim 1, wherein said first conveyor means comprises a plurality of endless belts mounted in parallel, and said drive means for said first conveyor means is a reversible motor.

6. An apparatus according to claim 1, wherein said second conveyor means comprises a plurality of endless belts mounted in parallel, and said drive means for said second conveyor means is a motor.

7. An apparatus according to claim 6, wherein said first and second conveyor means are mounted in transverse interfingered relative on a common shaft.

8. An apparatus according to claim 1, wherein said second detecting means further detects the retracted position of said second retaining means, and means for stopping said driving means for said second retaining means, responsive to the detection of said second retaining means at its extended and retracted positions.

9. An apparatus according to claim 1, and stop means for stopping said second conveyor drive means responsive to the detection of said first retaining means at its forward position by said first detecting means.

10. An apparatus according to claim 1, and a detecting switch for emitting a signal indicative of the completion of a loading interval of said first conveyor means; said drive means for said first conveyor means operating to drive said first conveyor means forwardly, and said drive means for said second conveyor means and said means for driving said second retaining means each operating to drive said second conveyor means and said second retaining means, respectively; all responsive to said signal.

* * * * *